US005432959A

United States Patent [19]

Ellsworth et al.

[11] Patent Number: 5,432,959

[45] Date of Patent: Jul. 18, 1995

[54] SYSTEM FOR REGULATING WATER FLOW IN A TOILET

[75] Inventors: Robert S. Ellsworth, Fairfax, Va.; John P. Durban, Mission Viejo, Calif.

[73] Assignee: Dakota Technologies Corp.

[21] Appl. No.: 177,750

[22] Filed: Jan. 5, 1994

[51] Int. Cl.[6] ..... E03D 5/10

[52] U.S. Cl. ..... 4/406; 4/DIG. 3

[58] Field of Search ..... 4/406, 345, DIG. 3

[56] References Cited

U.S. PATENT DOCUMENTS

| | | | |
|---|---|---|---|
| 3,334,359 | 8/1967 | Weingartner | 4/406 X |
| 3,590,397 | 7/1971 | Akamatsu et al. | 4/100 |
| 3,908,204 | 9/1975 | Hopkins | 4/100 |
| 3,965,492 | 6/1976 | Hendricks | 4/79 |
| 4,392,260 | 7/1983 | Bensen | 4/324 |
| 4,793,588 | 12/1988 | Laverty, Jr. | 251/30.03 |
| 4,876,751 | 10/1989 | Van Meter | 4/431 |
| 4,901,377 | 2/1990 | Weir | 4/415 |
| 4,918,764 | 4/1990 | Haselswerdt et al. | 4/406 |
| 4,989,277 | 2/1991 | Tsutsui et al. | 4/367 |
| 5,036,553 | 8/1991 | Sanderson | 4/406 X |
| 5,052,060 | 10/1991 | Makita et al. | 4/300 |
| 5,187,816 | 2/1993 | Chiou | 4/313 |
| 5,187,818 | 2/1993 | Barrett, Sr. et al. | 4/313 |

FOREIGN PATENT DOCUMENTS

| | | | |
|---|---|---|---|
| 2681891 | 4/1993 | France | 4/406 |
| 0197630 | 8/1990 | Japan | 4/406 |
| 3275825 | 12/1991 | Japan | 4/406 |
| 4124333 | 4/1992 | Japan | 4/406 |

*Primary Examiner*—Charles E. Phillips
*Attorney, Agent, or Firm*—Longacre & White

[57] ABSTRACT

The present disclosure concerns an electro-mechanical flushing system for a residential toilet. A powered valve is controlled by a timing circuit to pass one of a plurality of water flow volumes from a toilet tank to a toilet bowl. The same system also establishes an adjustable toilet bowl water level. A manual override feature permits the toilet to be operated in the absence of electrical power.

17 Claims, 4 Drawing Sheets

SYSTEM FOR REGULATING WATER FLOW IN A TOILET

BACKGROUND OF THE INVENTION a) Field of the Invention

The present invention concerns a system for regulating the flow of water in a conventional, residential toilet. In this application, a residential toilet ,is one in which a first valve controls the flow of water into a toilet tank and a second valve controls the flow of water from the toilet tank into a toilet bowl. On the other hand, a commercial toilet does not have a toilet tank and a single valve controls the flow of water directly into the toilet bowl.

b) Description of Related Art

Referring to FIG. 1, a conventional, residential toilet 10 includes a first valve 12 regulating water flow into a toilet tank 14 from a water supply 16. First valve 12 is controlled by a float 18 such that as the water rises to a predetermined level 20 in toilet tank 14, the buoyancy of float 18 causes first valve 12 to close, thereby inhibiting further water flow into toilet tank 14.

A second valve 22 is interposed between toilet tank 14 and a toilet bowl 24 to regulate water flow therebetween. Specifically, a "flapper" valve 22 is operated by a handle 26 via a pull chain 28. Between uses, water level 20 is maintained in toilet tank 14 by virtue of a valve face 30 sealingly abutting a valve seat 32. Actuation of handle 26 (in the direction indicated with arrow "A") causes pull chain 28 to lift valve face 30 away from valve seat 32, whereupon water in toilet tank 14 is passed through flapper valve 22 into toilet bowl 24. Flapper valve 22 is made to be buoyant so that the rush of flowing water from toilet tank 14 into toilet bowl 24 does not re-close flapper valve 22 (FIG. 1 shows the conventional, residential toilet in this state). As toilet tank 14 is drained, the buoyant force on flapper valve 22 is lost and valve face 30 re-engages valve seat 32, thereby re-closing flapper valve 22. Concurrent with draining toilet tank 14, float 18 drops below water level 20, whereupon valve 12 connects water supply 16 to toilet tank 14. Refilling toilet tank 14 commences when valve face 30 re-engages valve seat 32, and terminates when float 18 is buoyantly forced up to water level 20.

For proper operation, when the flapper valve 22 is closed, it is important that the pressure differential on the opposite sides of the flapper valve 22 overcome its buoyancy. That is to say, the combined force of the static pressure caused by the water in the toilet tank 14 on top of the flapper valve 22, plus the vacuum caused by the void underneath the flapper valve 22, exceeds the buoyant force of the flapper valve 22. This ensures the flapper valve remains closed between uses. Separating the valve face 30 from the valve seat 32 substantially reduces the pressure differential such that the buoyant force of the flapper valve 22 becomes superior to the force caused by the pressure differential. Consequently, the flapper valve 22 remains open from the time handle 26 is actuated, until toilet tank 14 is substantially drained. Further, flapper valve 22 must be sized to pass more water than water supply 16 can simultaneously provide. This ensures water supply 16 cannot maintain flapper valve 22 open indefinitely.

This known arrangement dispenses a single, predetermined water flow volume (based on the water level in a toilet tank of a given volume) without requiring the operator to modulate the duration or sequence for operating the valves. There is no mechanism which enables the user to select between a lower water flow volume, e.g. three gallons for liquid or light wastes, and a higher water flow volume, e.g. five gallons for solid wastes. Additionally, although it may be possible to forcibly alter the relationship between float 18 and the first valve 12 to adjust toilet tank water level 20, there is no provision in a conventional, residential toilet for adjusting toilet bowl water level 34.

SUMMARY OF THE INVENTION

An objective of the present invention is to provide an electro-mechanical toilet flush system which overcomes the aforementioned deficiencies in conventional, residential toilets.

Another objective of the present invention is to increase the flexibility of the toilet flush system, increase the reliability of the overall system, as well as allow the entire toilet flush system to be upgraded and improved by the use of electronic controls.

In particular, it is an objective of the present invention to provide an electrically controlled valve whereby different water flow volumes may be selected depending upon the type and volume of waste in the toilet bowl. The electronic control uses timers to precisely regulate water flow between the toilet tank and the toilet bowl. This enables the user to select either a lower ("economy") or a higher ("power") water flow volume, as well as set the water level in the toilet bowl for each flow volume.

It is yet another objective of the present invention to provide an electro-mechanical toilet flush system with a manual override control.

DESCRIPTION OF THE PREFERRED EMBODIMENT

Figure 1:
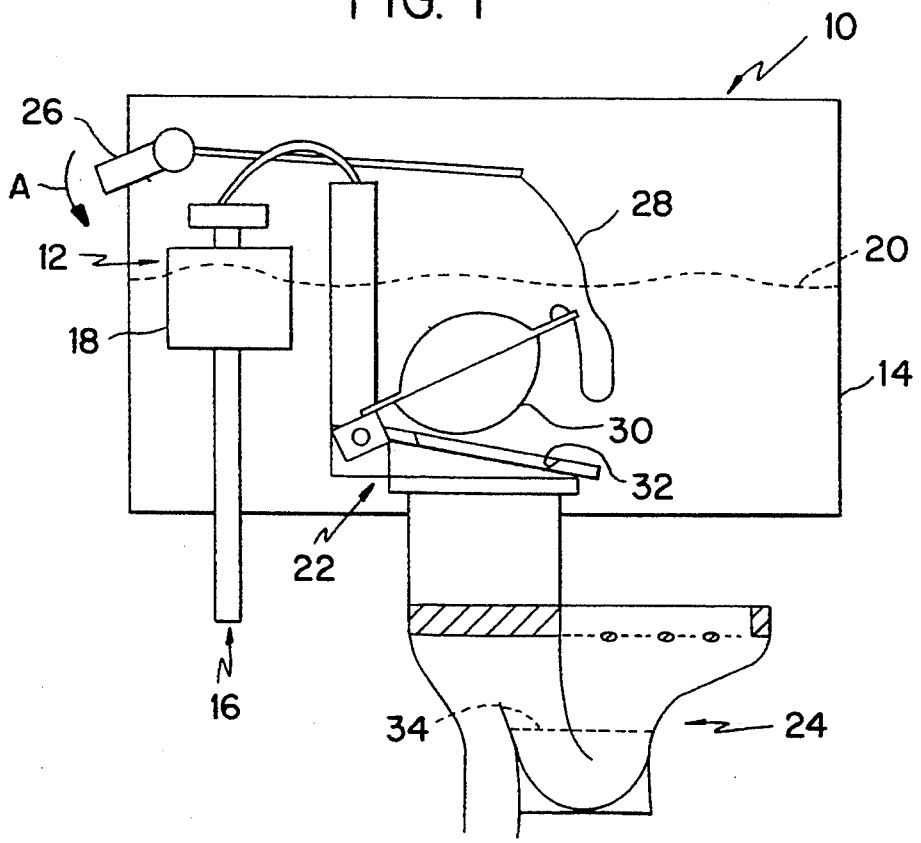
FIG. 1 shows a conventional, residential toilet flush system.

According to the present invention such as that shown in FIGS. 2–5, flapper valve 22, handle 26 and pull chain 28 are replaced with, respectively, a powered valve 35, a control unit 39 and a control wire 40.

Powered valve 35 positions valve face 30 with respect to valve seat 32 by means of an actuator 42. Actuator 42 may use pneumatic, hydraulic or electrical power to accomplish relative positioning. In the case of an electrically powered actuator, an electric motor or an electric magnet/solenoid may be used. In the preferred embodiment shown in FIG. 2, an electric motor 42 rotates a screw shaft 41 relative to a nut 43 so as to regulate relative displacement between a fixed housing 38 and an inverted cup 31. Although elements 41 and 43 have been disclosed as threadably related, it is envisioned that alternative arrangements may use cam surfaces, one or more detentes, etc. Essentially, elements 41 and 43 must be capable of converting the operation of actuator 42 into relative displacement between fixed housing 38 and inverted cup 31.

Figure 2:
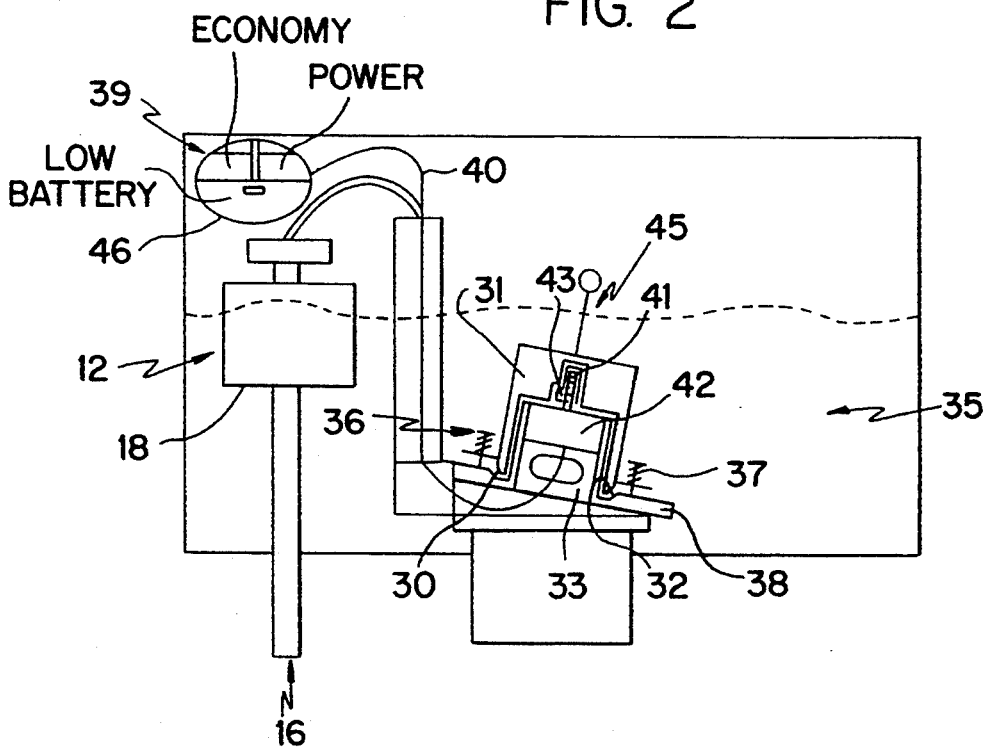
FIG. 2 shows a toilet flush system according to the present invention.
Figure 3:
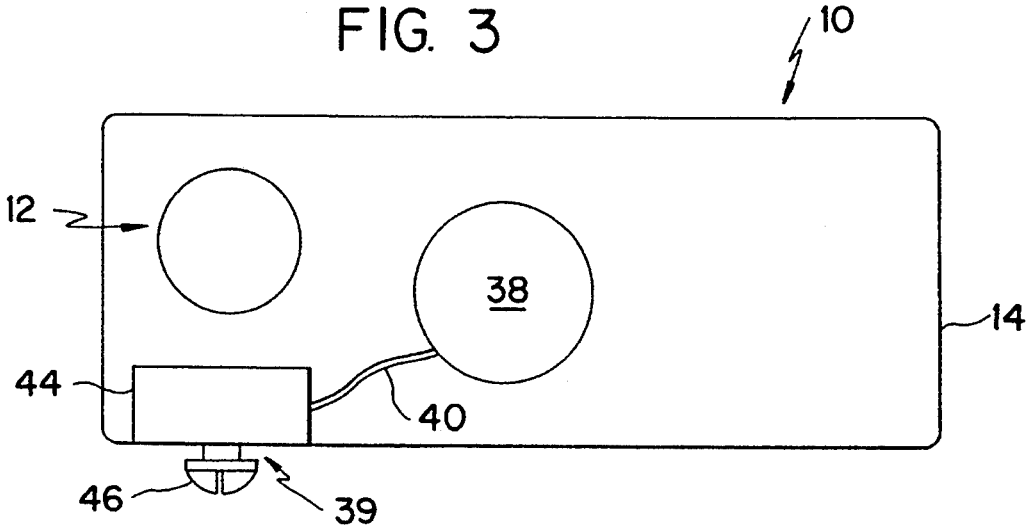
FIG. 3 is a plan view of the component arrangement according to the present invention.
Figure 4:
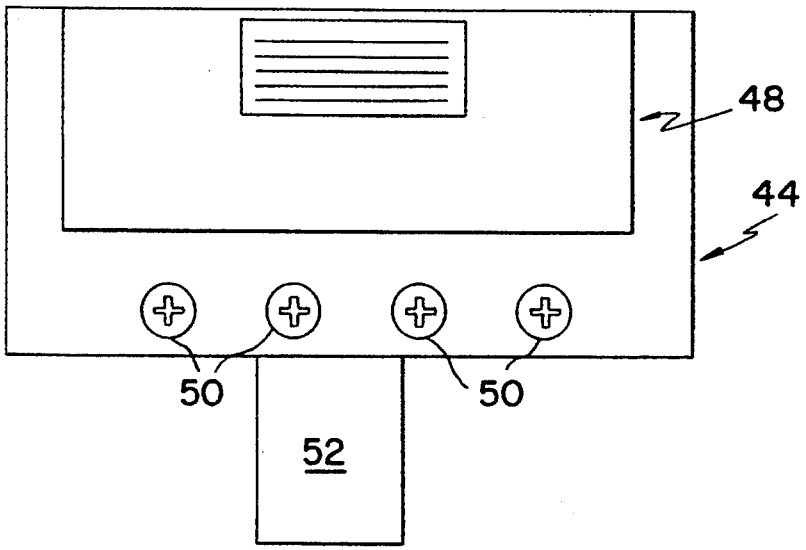
FIG. 4 is a plan view of a control box for a toilet flush system according to the present invention.
Figure 5:
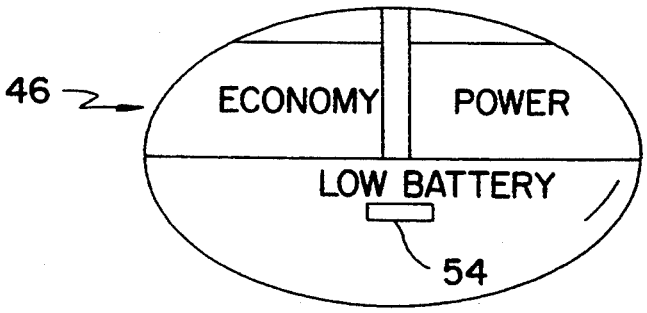
FIG. 5 is a front elevation view of a control panel for a toilet flush system according to the present invention.

Inverted cup 31 integrally supports valve face 30. One or more guides 36 (two are shown in FIG. 2) may also be associated with inverted cup 31 to ensure alignment between valve face 30 and valve seat 32.

It is envisioned that actuator 42 may be used to separate valve face 30 from valve seat 32 by drivingly displacing inverted cup 31 with respect to fixed housing 38. A counteractive device, e.g. one or more spring(s) 37 surrounding the guide(s) 36, may cooperatively assist actuator 42 in re-engaging valve face 30 with valve seat 32. Inasmuch as the nut 43 is fixed only against rotation with respect to the inverted cup 31, flushing may also be initiated manually by pulling a handle 45 to axially displace inverted cup 31 with respect to nut 43.

By virtue of cup 31 being oriented in an inverted position, an air pocket 33 is maintained. When valve face 30 and valve seat 32 are engaged, the pressure differential between the water pressure on cup 31 and the vacuum in air pocket 33 tends to reinforce the engagement. When valve face 30 is slightly separated from valve seat 32, the aforementioned pressure differential is reduced and the buoyant force established by air pocket 33 in cup 31 tends to maintain the separation. To re-close flapper valve 22, actuator 42 reversely drives nut 43 in cooperation with the influence of spring(s) 37.

Powered valve 35 is operated via a control unit 39. Control unit 39 includes a control box 44 located inside toilet tank 14 and a control panel 46 located outside toilet tank 14. Control box 44 includes a battery compartment 48, at least one timing circuit (described below), at least one adjuster 50 for regulating water flow volumes and/or toilet bowl water level 34, and a connector 52 extending through toilet tank 14 and operatively connecting to control panel 46.

Control panel 46 includes at least one selector for electing either the power, "P", or economy, , "E", water flow volume Control panel 46 may also include an indicator 54 signifying when the battery power supply is nearly depleted.

Figure 7:
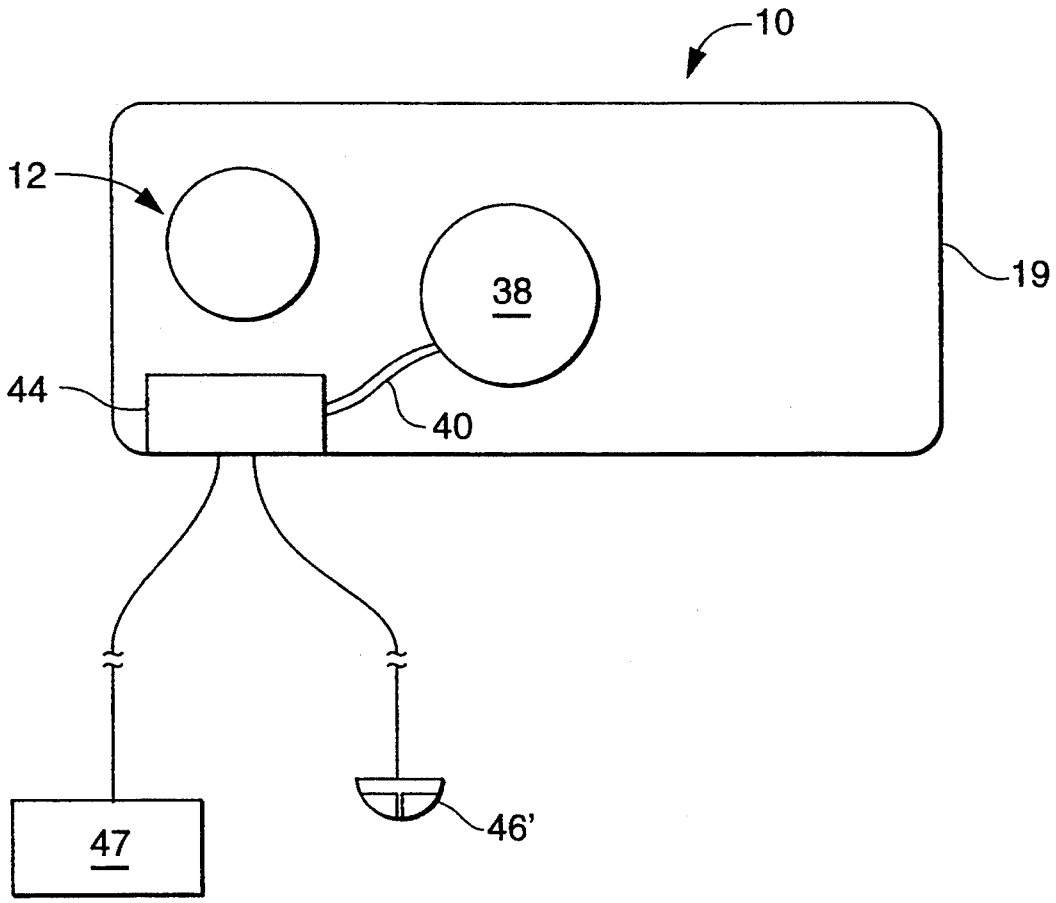
FIG. 7 is a plan view of the component arrangement according to a further embodiment of the present invention.

As shown in FIG. 7, control panel 46 need not be contiguous with control box 44, but rather may be located at a relatively remote location. Further, depressing a selector on control panel 46, 461 may be used to simultaneously operate an ancillary device such as an exhaust fan or chemical dispenser 47. Finally, the selector on control panel 46 need not be a button, but rather may also be a voice, thermal, etc. activated selector.

Operation of the present invention will now be described. Water is provided to toilet tank 14 from water supply 16. First valve 12 and float 18 regulate toilet tank water level 20 within toilet tank 14. Upon depressing the "E" selector on control panel 46, powered valve 35 displaces valve face 30 a first distance from valve seat 32, thereby opening an aperture between toilet tank 14 and toilet bowl 24. The timing circuit in control box 44 instructs powered valve 35 to close after the precise amount of time has passed to establish the "economy" volume of water to flow through the aperture. Similarly, upon depressing the "P" selector on control panel 46, powered valve 35 again displaces valve face 30 the first distance from valve seat 32. However, the timing circuit in control box 44 now instructs powered valve 35 to close after the precise amount of time has passed to establish "power" volume of water to flow through the aperture. Adjuster(s) 50 may be used to establish the time for one or both of the "economy" and "power" volumes of water flow.

A second aspect of the operation of the present invention will now be described. With the present invention it is possible to adjust the water level in the toilet bowl 24 after each selection of a water flow volume. Continuing with the above description of using the "economy" volume of water flow, the timing circuit instructs powered valve 35 to displace valve face 30 a second distance from valve seat 32. The second distance is generally substantially less than the aforementioned first distance thereby lowering the rate at which water flows through the aperture. The timing circuit subsequently instructs powered valve 35 to close after a predetermined time lapse necessary for obtaining the desired toilet bowl water level 34. Adjuster(s) 50 may be used to establish the time lapse following one or both of the "economy" and "power" volumes of water flow. It is envisioned that toilet bowl water level 34 may be established before or after powered valve 35 is closed to complete either the "economy" or "power" volumes of water flow. That is to say, the powered valve 35 may or may not be fully closed between flushing and establishing the toilet bowl level 34.

Figure 6:
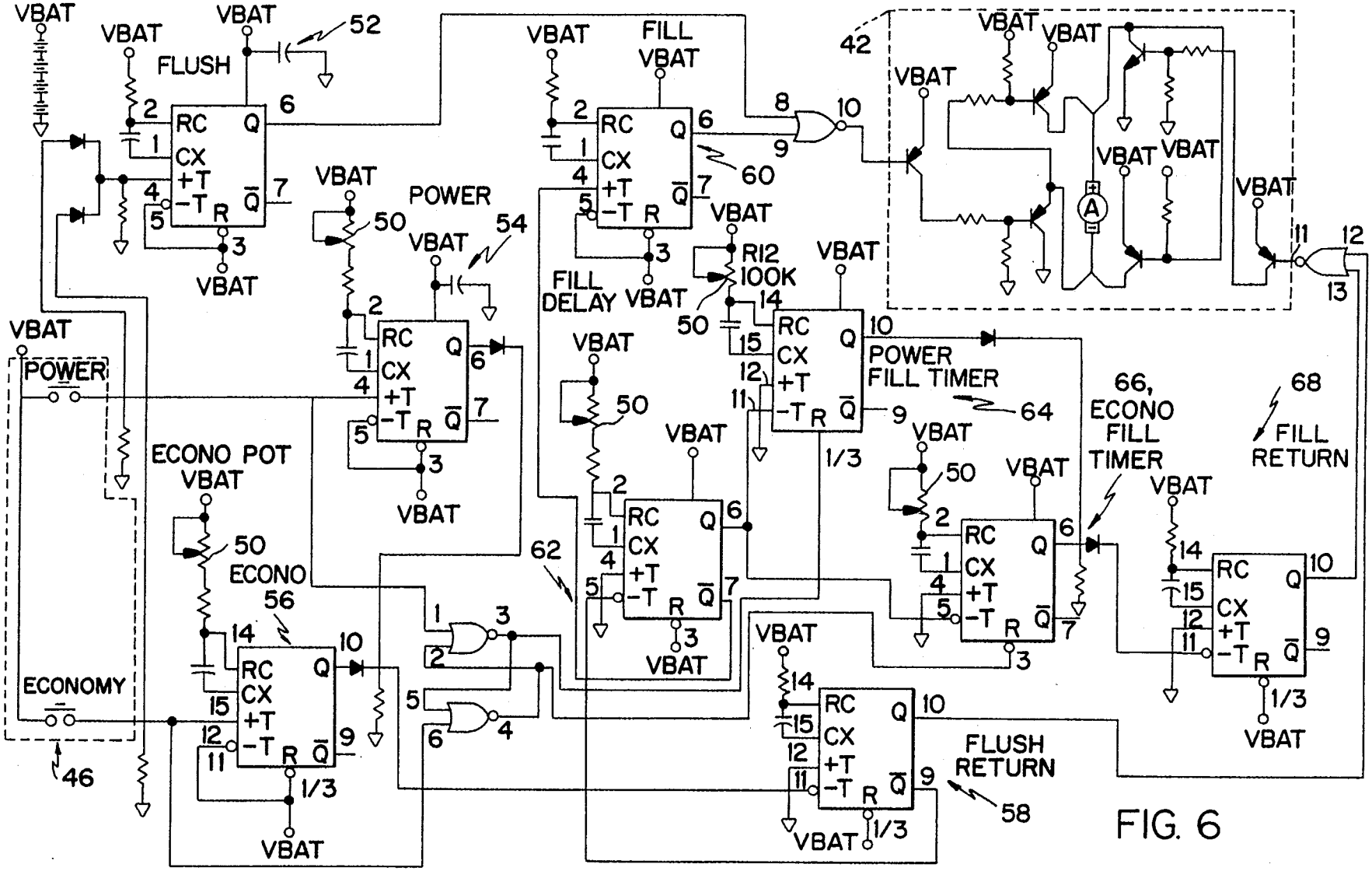
FIG. 6 is a schematic plan for a control circuit according to the present invention.

A preferred embodiment of a timing circuit according to the present invention will now be discussed with reference to FIG. 6. Upon selecting a flush cycle on control panel 46, i.e. "power" or "economy", actuator 42 is initially powered through a first integrated circuit 52. A second integrated circuit 54 or a third integrated circuit 56 establish the length of time necessary to obtain the "power" or "economy" water flow volumes, respectively. After the established time has lapsed for the desired water flow volume, actuator 42 is reversely powered through a fourth integrated circuit 58.

In order to obtain toilet bowl water level 34, fourth integrated circuit 58 also initiates the fill cycle by powering actuator 42 through a fifth integrated circuit 60. However, operation of fifth integrated circuit 60 is delayed by a sixth integrated circuit 62 while toilet tank 14 is refilled. This ensures a uniform pressure head so that measured times may be consistently related to water flow volumes. A seventh integrated circuit 64 or an eighth integrated circuit 66 establish the length of time necessary to obtain the "power" or "economy" toilet bowl water levels 34, respectively. After the established time has lapsed for obtaining the desired toilet bowl water level, actuator 42 is reversely powered through a ninth integrated circuit 68.

An adjuster 50 may be associated with one or more of the second 54, third 56, sixth 62, seventh 64, and eighth 66 integrated circuits. A separate adjuster 50 is shown for each of the aforementioned integrated circuits in FIG. 6, however, it is noted that a single potentiometer could be used to establish a common range of adjustment for the "power" and "economy" water flow volumes, as well as "power" and "economy" toilet bowl water levels 34. It is envisioned that a single potentiometer would be useful for establishing optimum water flow volumes given the available pressure at water supply 16.

What is claimed is:

1. A toilet flush system for regulating flow of water out of a toilet tank into a toilet bowl, said flush system comprising:

powered valve means for positioning a valve face with respect to a valve seat, said valve seat defines an aperture between said toilet tank and said toilet bowl, said valve face is adapted to close said aperture when said valve face is contiguous with said valve seat;

toilet tank water volume means for establishing an economy volume of water flow from said toilet tank through said aperture, and aperture, and establishing a power volume of water flow from said toilet tank through said aperture, said economy flow volume being substantially less than said power flow volume and being accomplished by said valve face being separated a given distance from said valve seat for a period of time to establish said economy flow volume and a greater period of time to establish said power flow volume; and toilet bowl water level means for establishing one of a first and second water level in said toilet bowl, said first and second water levels in said toilet bowl are achieved by water transfer from said toilet tank, through said aperture, to said toilet bowl by moving said valve face from said valve seat a distance substantially less than said given distance for one period of time for said first water level and a longer period of time for said second water level.

2. The toilet flush system according to claim 1, wherein said powered valve means includes guide means for aligning said valve face with said valve seat.

3. The toilet flush system according to claim 1, wherein said powered valve means includes closure means for pressing said valve facing toward said valve seat.

4. The toilet flush system according to claim 1, wherein said powered valve means includes an electric actuator.

5. The toilet flush system according to claim 4, wherein said electric actuator is an electric motor.

6. The toilet flush system according to claim 4, wherein said electric actuator is an electromechanical actuator.

7. The toilet flush system according to claim 1, further comprising:

selection means for electing one of said first volume of water flow and said second volume of water flow, as well as electing one of said first water level and said second water level.

8. The toilet flush system according to claim 7, wherein said selection means includes a battery, an electric switch and a control circuit for electing between said first volume of water flow corresponding with said first water level and said second volume of water flow corresponding with said second water level.

9. The toilet flush system according to claim 8, wherein said control circuit includes timing means for determining water flow through said aperture.

10. The toilet flush system according to claim 8, wherein said selection means further includes an indicator of minimum electrical power for operating the toilet flush system.

11. The toilet flush system according to claim 8, wherein said electric switch is relatively remote with respect to said toilet flush system.

12. The toilet flush system according to claim 1, further comprising:

manual override means for mechanically bypassing said powered valve means.

13. The toilet flush system according to claim 12, wherein said manual override means is operationally interposed between said powered valve means and said valve face.

14. The toilet flush system according to claim 13, wherein said powered valve means includes a screw threadably engaging a nut such that relative rotation causes relative axial displacement, and said manual override means permits relative axial displacement between said powered valve means and said valve face.

15. The toilet flush system according to claim 1, wherein said selection means simultaneously actuates an accessory which is relatively remote with respect to said toilet flush system.

16. The toilet flush system according to claim 15, wherein said accessory is a chemical dispenser.

17. The toilet flush system according to claim 15, wherein said accessory is a fan.

* * * * *